US006735830B1

(12) United States Patent
Merciel

(10) Patent No.: US 6,735,830 B1
(45) Date of Patent: May 18, 2004

(54) ION GENERATING DEVICE

(75) Inventor: Joël Merciel, Antibes (FR)

(73) Assignee: Genie ET Environnement, Antibes (FR)

( * ) Notice: Subject to any disclaimer, the term of this patent is extended or adjusted under 35 U.S.C. 154(b) by 0 days.

(21) Appl. No.: 09/926,654

(22) PCT Filed: May 30, 2000

(86) PCT No.: PCT/FR00/01477

§ 371 (c)(1),
(2), (4) Date: Jan. 10, 2002

(87) PCT Pub. No.: WO00/74188

PCT Pub. Date: Dec. 7, 2000

(30) Foreign Application Priority Data

May 31, 1999 (FR) ..... 99 07020

(51) Int. Cl.[7] ..... H01T 23/00

(52) U.S. Cl. ..... 250/324; 445/24; 445/50; 361/231

(58) Field of Search ..... 250/324; 445/24, 445/50; 361/231

(56) References Cited

U.S. PATENT DOCUMENTS

| | | | | |
|---|---|---|---|---|
| 5,100,355 A | * | 3/1992 | Marcus et al. | 445/24 |
| 5,509,843 A | * | 4/1996 | Akama | 445/50 |
| 5,788,749 A | | 8/1998 | Breton et al. | |
| 5,789,749 A | * | 8/1998 | Breton | 250/324 |

FOREIGN PATENT DOCUMENTS

JP 07/282953 10/1995

* cited by examiner

*Primary Examiner*—John R. Lee
*Assistant Examiner*—Zia R. Hashmi
(74) *Attorney, Agent, or Firm*—Dennison, Schultz, Dougherty & MacDonald

(57) ABSTRACT

The invention relates to apparatus for generating ions in a gaseous medium, the apparatus comprising one or more needles (40) each presenting a shank (40.1) and an emitter end (40.2), a sheath (42) of composite material comprising glass fiber reinforced unsaturated polyester surrounding the shank (40.1) of each needle, and means (44, 46, 80) for applying a voltage between two portions of the shank of each needle.

38 Claims, 4 Drawing Sheets

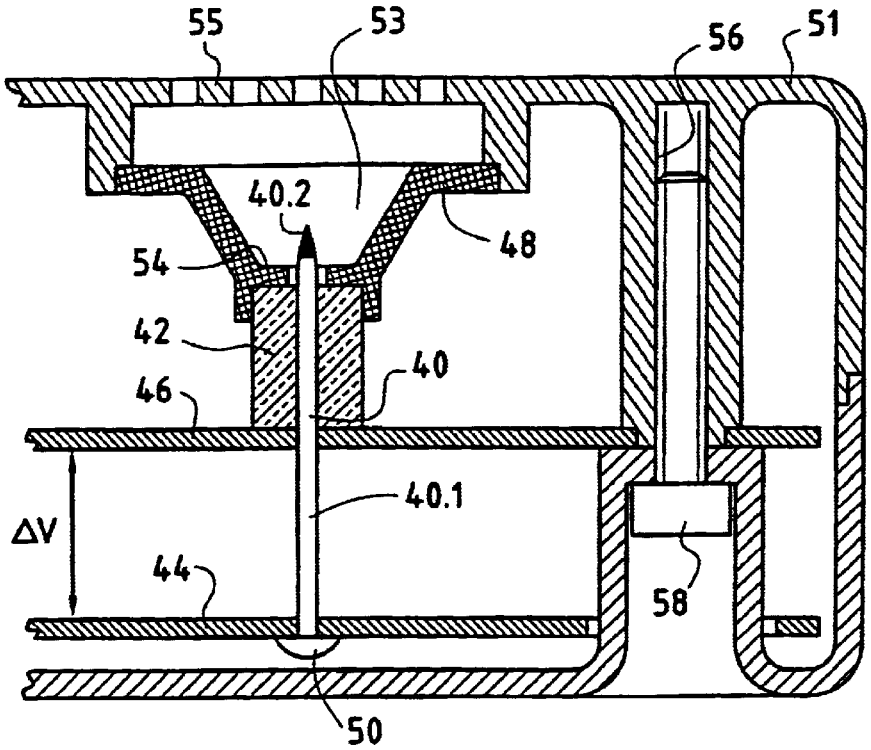
FIG.5
FIG.6
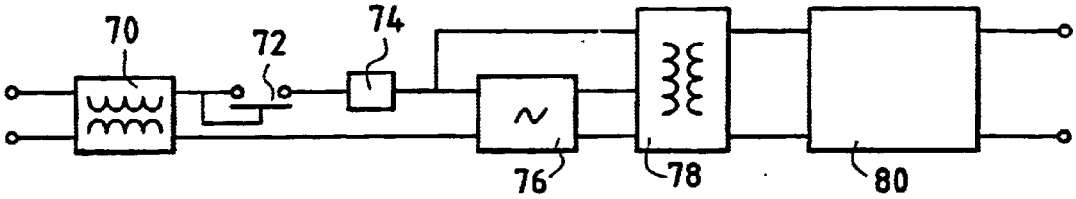
FIG.7
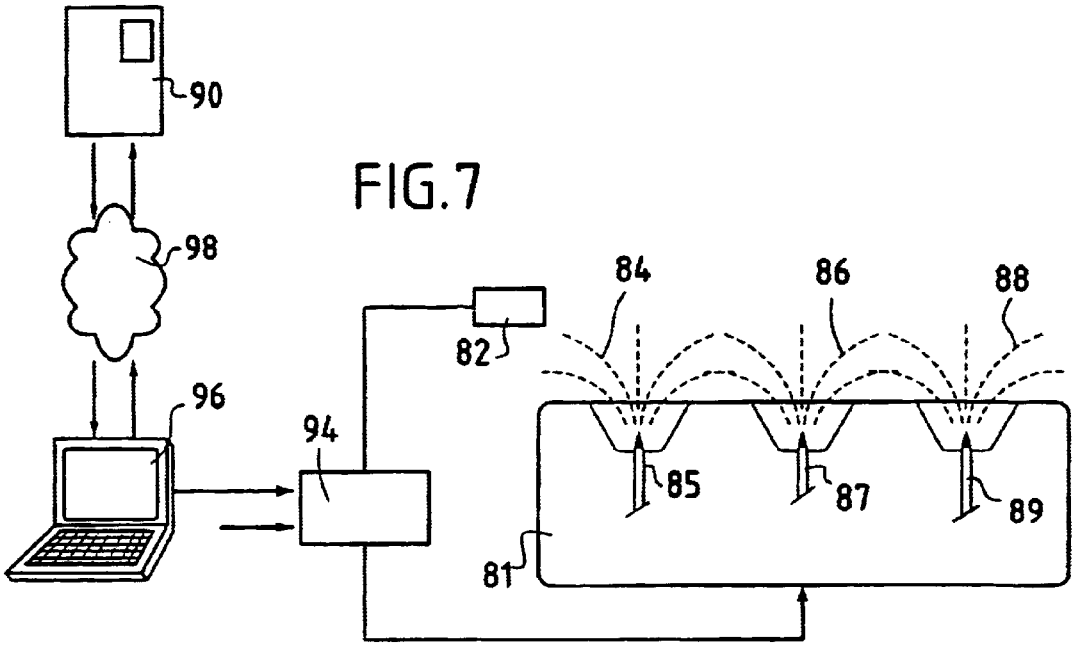

ION GENERATING DEVICE

TECHNICAL FIELD AND PRIOR ART

The present invention relates to electronic apparatuses of the "ion generator" type. Such apparatuses enable a certain density of ions (e.g. of negative oxygen ions in air) to be maintained within an enclosure or in premises in order to make the place where ions are being diffused more healthy.

An application of the invention relates to maintaining a certain density of ions, e.g. negative oxygen ions in air, inside any closed or semi-open enclosure or premises having a ventilation system in order to restore health to the place where controlled ion diffusion is being applied.

Such an ion generator apparatus is known from document WO 96/02966.

The structure of that known apparatus essentially comprises:

- a first subassembly constituted by an electron optics system; and
- a second subassembly constituted by a power supply unit delivering a high voltage of the order of 4 kV to 5 kV between an output S and a common ground M, and at an impedance of about 100 Megohms; said second subassembly supplying said electron optics with the high voltage required for producing ions.

In more detail, the electron optics structure comprises the following elements which are shown diagrammatically in FIG. 1.

A first plate 2 of insulating material prevents any emission of electrons (corona effect) from around the rear of the apparatus.

A conductive second plate 4 carries on its rear face emissive "points" such as the point 6. An insulating third plate 8 secured to the plate 4 is situated in front of it.

The "points" 6 are constituted by long thin needles of stainless metal (Ag), and each has an emissive free end with a radius of a few micrometers.

An electron emission matching structure is constituted by a dielectric "sheath" 10 and a dual cone structure 12 secured to the sheath and made of the same insulating material. The matching structure also has an internal plane structure (plate 14) secured to the cone structure, extending therefrom and made of the same insulating material. It is fixed to the outside wall 22 of the housing containing the apparatus.

A system of composite plates 16, 18 has an insulating inside face 18 and a conductive top face 16 connected to ground. A hole 20 allows the sheath and the emitter needle to pass therethrough.

A final plate 22 constitutes a housing containing the apparatus. It is made of a material that is a very poor conductor, and it is connected to the conductive plate 16. A "leakage" resistor 24 represents the real resistance of the plate 16 for draining off the charge taken from the local space charge that results from the points emitting electrons.

In that apparatus, the plate 16 carried by the insulating plate 18 is connected to ground (zero potential), and the emitter needles are sheathed in dielectric.

The zero equipotential is determined by the field plate 16, its distribution depending on the positions and the length of the needles, and on the characteristics of the dielectric sheath and of its distal cone 26.

Because of the relatively high permittivity of the sheath and its distal cone, the zero equipotential "drops down" practically onto the outside surface of said sheath.

In theory, this serves to ensure that an electric field of very high maximum value is present at the free end of the needle.

Such an apparatus operates at a voltage of less than 4.5 kV.

There also exist apparatuses that operate at voltages lying in the range 6 kV to 12 kV.

All those apparatuses present certain drawbacks.

Firstly, their performance is limited and incapable of ensuring long term and consistent production of ions. In particular they do not make it possible to cause a negative flux of ions to circulate constantly in the site or the enclosure to be treated.

Nor do they make it possible to provide and extend the flux of ions and the diffusion of ions throughout the entire enclosure or premises to be treated, and they are not very reliable concerning actual production of ions.

Known apparatuses also have rather low efficiency in producing ions after they have been in use for a while. In particular, after they have been used several times, they are found to be poor at producing oxygen ions effectively.

Those that operate at a voltage in excess of 6 kV are dangerous because of the aggressivity and the toxicity of the peroxiding substances they produce, such as ozone and nitrogen oxides. They also give rise to electrostatic fluxes. In addition, the use of voltages that are too high is very difficult to control or master, and is therefore very dangerous for an everyday application.

Apparatuses which operate at a voltage that is less than or equal to 4200 volts, and in particular those of the type described above with reference to FIG. 1, implement electrical power supply methods and manufacturing methods that tend to create a matching system for supplying power and creating an ion flux.

However, whatever the systems or protective methods in existence heretofore, they do not manage to avoid creating rubbing and air circulation and diffusion inside the housing, thereby building up static charge and/or favoring the formation of peroxide type compounds. Unfortunately, static charge reduces the yield of the mass of ions created.

Nor do such apparatuses ensure that the emitter needles are consistent and stable, nor do they ensure that the production from each needle is consistent, regular, and controllable in order to produce ion fluxes having a lifetime that is sufficient for enabling an intended or identified premises to be treated normally and durably.

The apparatus described in document WO 96/02966 also requires a conical opening 28 which makes it possible to touch the needles, which is dangerous in some applications, in particular in cars or in day nurseries.

Furthermore, the electrical connection between the plates 16 and 22 is provided by means of an electric wire, thus requiring additional connections and complicating the apparatus and manufacture thereof. These connections also create a deficiency in the high voltage power supply, and do not prevent losses or static charges. The apparatuses therefore cannot genuinely ensure high quality production of ions and dispersal of the ion flux into the atmosphere.

Corona effects also occur in those known apparatuses. These effects cause polluants to be deposited in the V-shaped zones 30 constituted by the distal cones 26 and the conical openings 28. These zones are in contact with the atmosphere and the flows of air circulating therein, thereby creating parasitic compounds of peroxide or other types. Corona effects prevent known apparatuses from operating effectively.

Finally, that type of apparatus does not provide an effective and long-lasting solution to treating the intended enclosure, and to restoring the place to health.

Such apparatus also fails to create genuine isolation and genuine sealing, because it needs external power supplies and resistances in order to operate.

Finally, the structure of the sheath 20 secured to the cone 12 itself secured to the plates 14, is complex to manufacture industrially.

In both cases, a zone of plasma extends very widely from the emitter points. That gives rise to various peroxides being formed which are dangerous for human and animal health, such as $NO_x$, and which also serve to reduce the desired emission of ions by an attraction and screening process.

In addition, the magnitudes of the electric fields in both of the above-mentioned existing devices are highly random in the vicinity of the emitter points.

In order to favor diffusion, dispersal, and circulation of ions, some apparatuses include a driving fan. That gives rise to a system that is expensive, that consumes excessive energy, and that produces noise disturbance. Furthermore, such a system stirs up the air causing dust to collect on the blades of the fans or the propulsion system, thereby increasing air rubbing phenomena, thus making electrostatic disturbances more dense, and in turn reducing the ion flux emitted into the enclosure or volume to be treated.

In another aspect, known apparatuses are unsuitable for adapting to a variety of premises or environments.

If a given apparatus is installed in certain premises, there are no means enabling its production of ions to be modified as a function of how the premises are occupied, whether the "occupation" relates to humans or to the environment constituted by furnishings or coverings on the walls of the premises. Nor does any system enable the production of ions to be matched to the place where the premises is to be found. Unfortunately, requirements are not the same depending on where the premises is situated, for example in a city or in the country.

Finally, known apparatuses do not enable an apparatus to be made in which the number of emitter needles or points is more than just a few. At best, known apparatuses have fewer than a score of needles.

SUMMARY OF THE INVENTION

The invention firstly provides apparatus for generating ions in an atmospheric or gaseous medium, the apparatus comprising:

- one or more needles, each presenting a shank and an emitter end;
- a sheath of composite material which surrounds the shank of each needle; and
- means for applying a voltage between two portions of the shank of each needle.

The composite material comprises an unsaturated polyester reinforced with glass fibers.

The use of such a composite material as the sheath material provides a considerable improvement concerning the emission of electrons and the production of ions that are actually obtained.

Such a material can have resistivity equal or substantially equal to $10^{12}$ Ω.m, whereas document WO 96/02966 recommends using a material of resistivity greater than or equal to $10^{15}$ Ω.m.

Selecting this material also avoids the need to make a distal conical structure in the vicinity of the end of each needle and secured to the sheath, and also avoids the need to make a proximal conical structure adjacent to the emitter end of each needle.

The apparatus for generating ions (positive ions or negative ions) is thus much easier to manufacture, and the zero potential lines drop down along the sheath without any need for conical structures.

The sheath made around the needle can be cylindrical in shape, without having a conical end portion.

The composite material can contain 50% to 90% by weight of glass relative to the total weight of the material. It can also include mica.

The needles can be made of a material selected from titanium, platinum, a compound of titanium and platinum, silver, stainless steel, brass, nickel, and an alloy of these materials.

The means for applying a voltage between two portions of the body of each needle comprise, for example, first and second plates situated at two different heights along each sheath, and means enabling a high voltage to be applied between the two plates.

An electrical power supply circuit can be incorporated on one of the plates. Thus, connections between the ionizer apparatus and the outside are reduced, thereby achieving a corresponding reduction in problems of micro-drafts or leaks from the outside towards the inside of the apparatus, and thus avoiding the problems mentioned above in the introduction.

In an embodiment, one of the plates includes an assembly constituted by the high voltage power supply and electronic means enabling said voltage to be applied along the body of each needle.

In another particular embodiment, for apparatus having a plurality of needles, each needle can be surrounded by a sheath, with the sheaths being interconnected in pairs.

This favors mechanical holding of the needles and also prevents instabilities in the production of ions, and prevents the production of interfering compounds.

The sheaths can thus be paired by means of a web of material that is identical to the material of the sheaths, with the two sheaths of each pair and the web being formed as a single block. A structure is then obtained that is highly advantageous from the industrial manufacturing point of view.

In another aspect, the invention also provides a circuit for regulating an ionizer apparatus, the circuit further including means for regulating the voltage applied between the two portions of the shank of each needle, e.g. from a transformer or a transmitter-regulator; the apparatus thus makes it possible to control ion diffusion.

The ionizer apparatus may advantageously be of the type described above in the context of the present invention.

In a particular embodiment, the voltage regulator means comprise means for measuring the quantity of ions produced by the apparatus, means for comparing said quantity of ions produced with an ideal quantity required, and means for varying the applied voltage as a result of the comparison between the quantity of ions produced and the quantity of ions required.

The ideal quantity of ions required can be determined on the basis of a corrected volume taking account of the real volume of the premises in which the ion generator apparatus is installed, and also the content of the premises and/or its environment.

Thus, a user can regulate the operation of ionizer apparatus as a function of its environment, e.g. of human occupation and/or of furnishings and/of wall coverings in the premises, or indeed as a function of the place where the premises is to be found.

Such regulation can also be performed automatically, on a single occasion or regularly over time.

The means for varying the applied voltage can be automatic means or manual means.

The invention also proposes an ion detector comprising:

means for sensing ions or a quantity of ions in an atmosphere;

indicator means for indicting the presence of ions; and switch means for switching the indicator means as a function of the quantity of ions sensed by the ion sensor means.

By way of example, the switch means comprise a transistor biased by a voltage source when switching occurs.

The detector can be used with the above-described voltage regulator means.

BRIEF DESCRIPTION OF THE FIGURES

The characteristics and advantages of the invention will appear better on reading the following description. The description relates to embodiments given by way of non-limiting explanation, and it refers to accompanying drawings in which:

FIG. 5 shows the general structure of a device of the invention in its housing;

FIG. 6 is a block diagram of an electrical circuit incorporated in apparatus of the invention;

FIG. 7 is a diagram showing a system for controlling ionizer apparatus; and

DETAILED DESCRIPTION OF THE EMBODIMENTS

Figure 1:
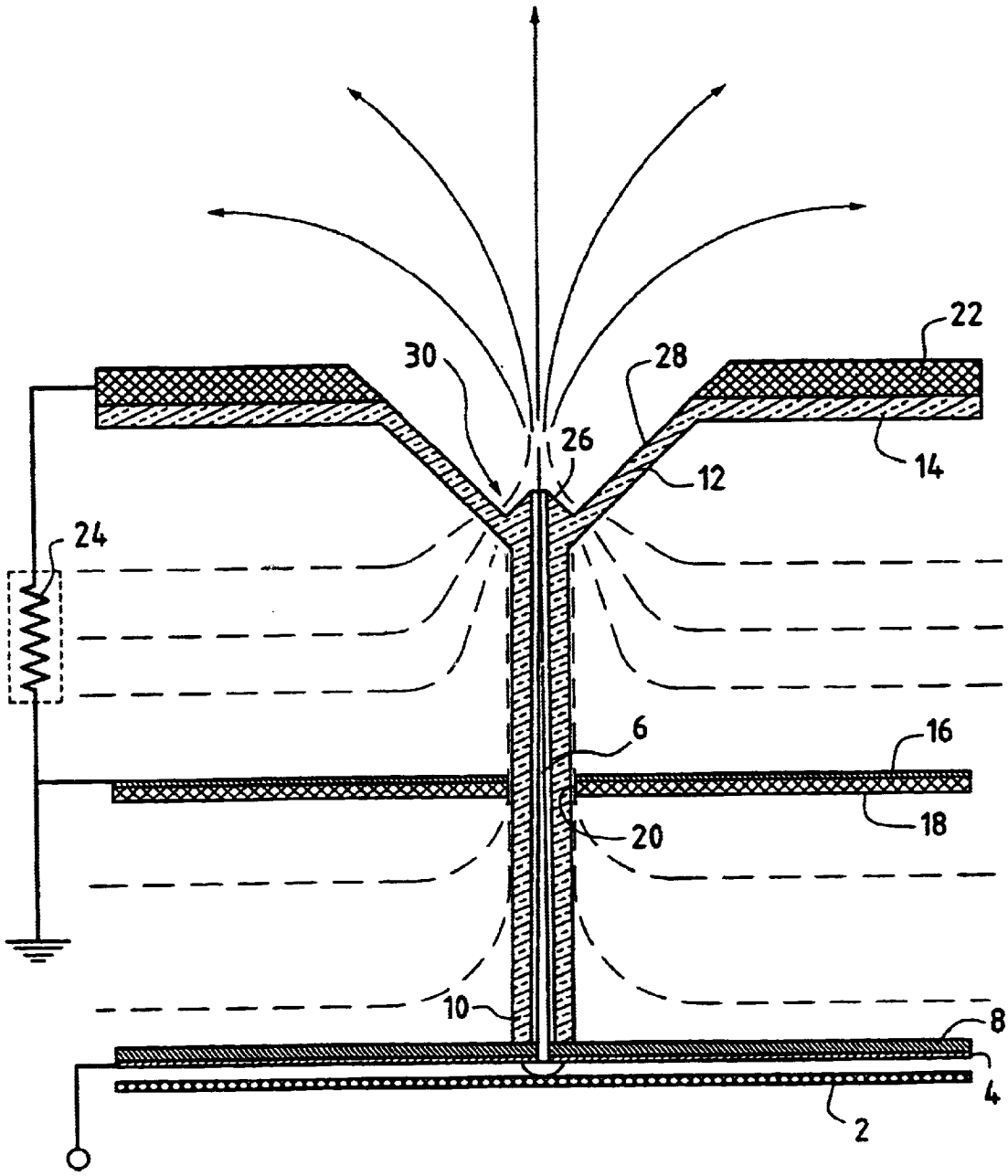
FIG.1 Prior Art
FIG. 1 shows the structure of prior art apparatus.

A first embodiment of apparatus of the invention is described with reference to FIG. 2.

The apparatus comprises an emitter needle or "point" 40 essentially made of a noble material. The needle is preferably made of titanium or of platinum or of a compound of those two materials.

It is also possible to use a stainless metal or indeed silver, stainless steel, brass, or nickel, or an alloy of those materials, e.g. a brass-nickel alloy or a silver-stainless steel alloy. Nevertheless, it is titanium or platinum or a platinum-titanium mixture that provides best performance for the apparatus, as explained below.

The needle has a cylindrical portion 40.1 extended by a conical end 40.2.

It is inserted in a sheath 42 of a composite material based on glass fiber reinforced unsaturated polyester.

Such a material can also include chlorophthalic resin.

The material can be formed by pultrusion, for example.

By way of example, the material of the sheath 42 can have a glass content lying in the range 50% by 80% by weight of the composite material. Its resistivity is equal to about $10^{12}$ Ω.m.

The physical, mechanical, and electrical characteristics of this material are summarized by way of indication in Table I below, respectively for solid bars or rods, and for section members.

The resistivity characteristics can be obtained, for example, by the ASTM D257 method.

The characteristics given can vary as a function of the intended applications or embodiments.

TABLE I

| PROPERTIES | SOLID BARS AND RODS | SECTION MEMBERS |
|---|---|---|
| PHYSICAL | | |
| Glass content | 70%–80% by weight | 50%–65% by weight |
| Specific gravity | 2 | 1.8 |
| Dercol hardness | 45/50 | 45/50 |
| Water absorption | 0.30% by weight | 0.30% by weight |
| Linear thermal expansion coefficient | $5.4 \times 10^{-6}$/K | $9 \times 10^{-6}$/K |
| Thermal conductivity | 0.288 W/K.m | 0.144 W/K.m |
| MECHANICAL | | |
| Traction strength | 690 MPa | 207 MPa |
| Elastic modulus in traction | 41.4 GPa | 17.2 GPa |
| Bending strength | 690 MPa | 207 MPa |
| Shear stress | 35 MPa | 35 MPa |
| Axial compression strength | 414 MPa | 276 MPa |
| ELECTRICAL | | |
| Parallel dielectric resistance | 2380 kV/m | 984 kV/m |
| Resistivity | $10^{12}$ Ω.m | $10^{12}$ Ω.m |
| Resistance to arcing | 120 s | 120 s |

Dielectric materials of resistivity lying in the range $10^4$ Ω.m to $10^{14}$ Ω.m or in the range $10^4$ Ω.m to $10^{16}$ Ω.m can also be used.

Minerals such as mica can also be added to the basic composition of the sheath, thereby reinforcing its dielectric properties.

The needle-and-sheath assembly is associated with means suitable for establishing an intense electric field at the end of the needle, or for establishing a potential difference along the needle, with the field or the potential difference being sufficient to enable electrons to be produced by the emitter point.

Zero potential lines drop down along the sheath 42 without it being necessary to provide cone structures.

These means which enable an intense electric field to be established at the end of the needle or which enable a potential difference to be established along the needle preferably comprise first and second plates 44 and 46 between which a suitable potential difference is established.

The composite material sheath 42 in combination with the two plates 44 and 46 then makes it possible to establish an appropriate voltage along the shank of the emitter needle. It serves to provide an electric field that is controllable and modifiable, and of very high value, at the free end of each point. The equipotential lines are folded down almost onto the outside surface of the sheath. This gives rise to an increased ion flux and to a great reduction in the plasma confinement zone. Furthermore, emissions of peroxide type substances are reduced (ozone production of less than 1 part per billion ($10^9$)).

The combination of a sheath made of composite material as defined above and needles made of platinum or titanium or a mixture of platinum and titanium is particularly advantageous since it makes it possible to achieve an optimum electric field for given power supply voltage.

Thus, the flux of emitted electrons is reinforced and the efficiency of ion production is improved.

In addition, the flux obtained is emitted in a manner that is long-lasting and stable.

Finally, selecting this combination of materials significantly reduces the production of peroxide type compounds or of other interfering or toxic compounds, and also lateral corona effects.

The emitter needle 40 is fixed on the base plate 44 by soldering 50 or by crimping or by any other equivalent means enabling the needle 40 to be held securely to the plate.

Figure 3A:
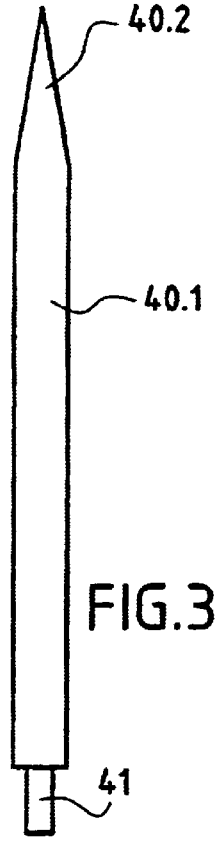
FIGS. 3A and 3B show the structure of an emitter needle that can be used in an apparatus of the invention.

An example of a needle shape that is suitable for use is given in FIG. 3A.

This needle comprises a cylindrical shank 40.1, a conical end 40.2, and a fixing peg 41, e.g. likewise cylindrical in shape, but of diameter smaller than the diameter of the shank 40.1.

A corresponding hole 47 of diameter that is substantially equal to the diameter of the peg 41 is made through the plate 44.

Figure 3B:
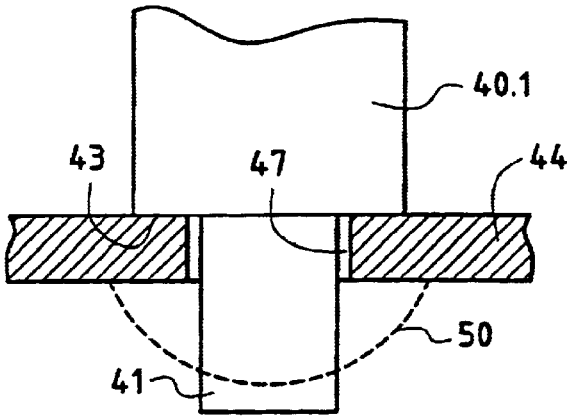

When the needle is positioned in the hole 47, the peg projects from the plate, e.g. by about 2 mm, so as to enable a high quality connection to be made suitable for holding the needle securely. The shape of the final solder 50 is shown in dashed lines in FIG. 3B.

The plate 44 is then itself engaged between the bottom face 43 of the cylinder constituting the shank 40.1 and the solder 50 on the other side of the plate 44.

Such secure retention serves not only to keep the needle stable and thus keep the direction in which electrons are emitted stable; but also avoids any flow of micro-drafts which could give rise to harmful substances being created, e.g. peroxides.

In addition to the intrinsic quality of the sheath design, such secure retention also makes it possible to avoid any rubbing which generates electrostatic charge that interferes with proper operation of the apparatus.

Thus, the solder serves not only to hold the needle, but also to isolate and seal the inside of the apparatus from any flow of air.

The soldering can be performed by subjecting the needle support plate 44 to flow or "wave" soldering. This ensures that uniform soldering is obtained and also reduces the chance of solder points breaking.

In general, whatever the fixing means used, it should likewise, preferably, and for the same reasons achieve the same functions of secure retention, without any possibility of rubbing or of displacement, and without any possibility of air flow, and without requiring mechanical force.

Mechanical forces can have repercussions throughout the apparatus and its housing, thereby giving rise to micro-leaks allowing air drafts to circulate or allowing rubbing to occur which can give rise to static charge. Even very small amounts of air drafts or rubbing can give rise to disturbances in the production of ions by the apparatus. In particular, drafts of air encourage the production of peroxide compounds and cause static charge to build up which then impedes the quality and the magnitude of the ion flux.

At their ends 40.2, the emitter points can be covered in a film of gold (represented in black in FIG. 2), thereby increasing the suitability of the point and the sheath for eliminating disturbing phenomena such as the production of electrostatic charge, electromagnetic disturbances, and the production of any peroxides or other toxic substances. This film of gold can also be applied to the entire shank of the needle.

The film of gold at the end 40.2 of the point, and the materials chosen to constitute the needle 40 and the sheath 42, all serve to ensure electrical conductivity and ion production without disturbance, and to do so without any lateral corona effect.

The apparatus can thus produce a flux of ions which is very large, and can do so in continuous and stable manner.

Figure 2:
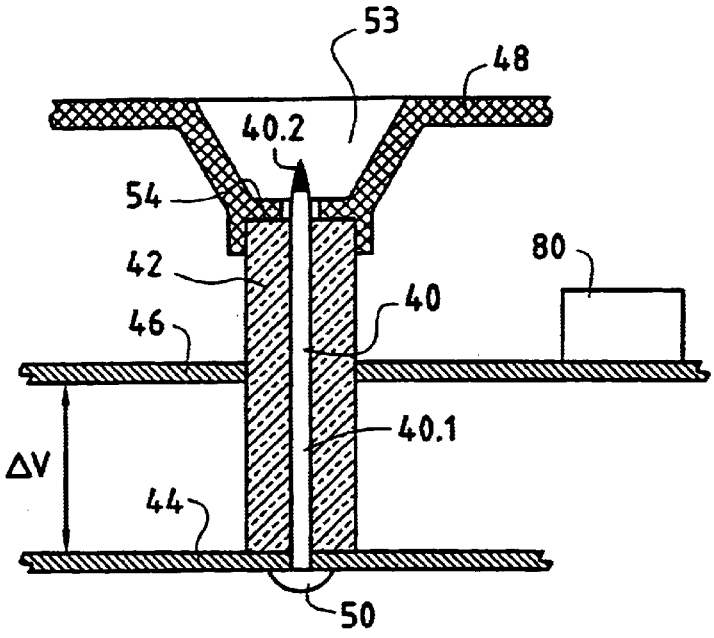
FIG. 2 shows the structure of apparatus of the invention.

In FIG. 2, reference 48 designates a wall of a housing in which the set of needles, their sheaths, and the plates 44 and 46 can be incorporated. A depression 53, e.g. of conical shape, is formed in the wall 48 to receive the end 40.2 of the emitter point.

As can be seen in FIG. 2, the housing can bear against the top face 54 of the sheath 42. However, unlike the apparatus described in document WO 96/02966, the invention does not require a plate to be implemented like the plate 14 (see FIG. 1) which is made of the same material as the sheath 10 and which is integral with the cone structure 12 and with the sheath 10. This requirement in the prior art apparatus for an integral unit that is difficult to make gives rise to very considerable manufacturing difficulties. Because no connection is required between the outside plate or wall 48 of the housing and the sheath 42 in the apparatus of the invention, the apparatus can be simpler to assemble. This easier assembly is particularly advantageous when the number of emitter points is high. The apparatus of the invention thus provides a considerable amount of simplification.

In addition, the electrical properties that result from the choice of materials for the sheath 42 and for the needle 40 require no connection via an outside resistor of the type represented by the resistor 24 in FIG. 1. The apparatus is thus simplified in this respect also. Safety is also improved since the presence of an electrical conductor is eliminated, which is of great value in an environment having high or very high voltages. Such a conductor gives rise to various phenomena, in particular electrical disturbances, thereby reducing the ion production process.

In an embodiment, the emitter needles/points are about 18 mm to 32 mm long, e.g. 30 mm long. A mean length of 24 mm is suitable for industrial implementation of a consumer product, e.g. in an application to cars. The mean diameter of each needle can be 1 mm, however it can lie anywhere in the range 0.8 mm to 1.8 mm or even 2 mm, depending on the requirements for industrial production.

The needles are subjected directly and without the use of wires to a high voltage feed at 4.3 kV to 6 kV. The emissive portion of the conical section 40.2 is covered in a film of gold and its length lies in the range 2 mm to 2.5 mm. In an example, this portion 40.2 has a length of 5.8 mm and is covered in a film of gold over a length of 2.4 mm. The radius of the end of the point is a few micrometers.

By way of example, the outside diameter of the sheath 42 is 6 mm. This sheath allows a needle 40 to pass along its central cylindrical bore. This passage is preferably a force-fit so as to avoid any rubbing once the needle is in place, thereby avoiding any mechanical effect and any air flow that could give rise to electrostatic and disturbing phenomena.

In general, the needle is preferably inserted into the sheath so as to prevent any air from passing between the sheath and the shank 40.1 of the needle, thereby improving ion production, in particular by avoiding the production of peroxides (in particular $NO_x$).

The plate 48 of the housing which is about 2.5 mm thick, has an opening with a half-angle at the apex that is substantially equal to 30°, and a mean depth of 8 mm, which depth could lie in the range 3 mm (or 5 mm) to 15 mm.

A special adhesive can be used to lock and isolate the needle in the sheath 42.

By way of example, the first plate 44 is made of composite material. It has an insulating face and a total thickness of 1.5 mm, for example. The material used is completely integrated in said first plate and has a thickness lying in the range 0.8 mm to 1.5 mm, with the overall thickness lying in the range about 1.5 mm and 2 mm. It serves to eliminate any corona emission from around the rear of the apparatus.

By way of example, the second plate is constituted by a composite material whose inside face is insulating and whose top face is conductive and connected to ground (zero potential).

Figure 4:
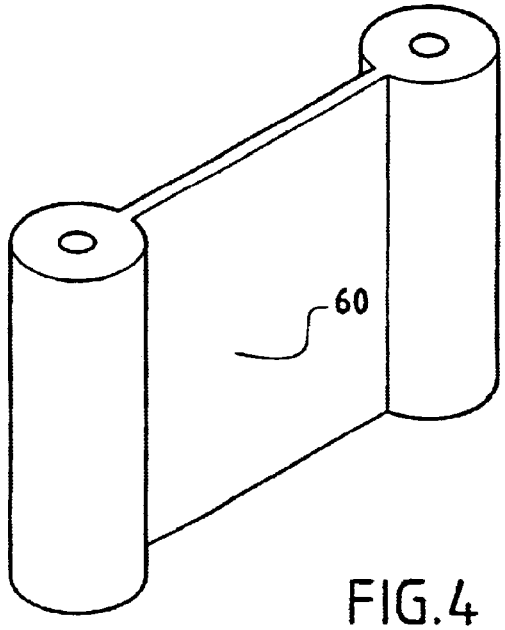
FIG. 4 shows the structure of a pair of sheaths secured to each other.

In an embodiment as shown in FIG. 4, the composite material sheaths are assembled together in pairs by means of one web 60 per pair, which web is made of the same material as the sheaths. In practice, a pair of sheaths and their web are made as a single block. This structure serves to reinforce the mechanical support provided to the needles, and also to ensure that they are kept at a constant distance apart. The stability of the emitted electron fluxes is improved thereby, and any possibility of rubbing or displacement, even to a very small extent, is thus further reduced.

The apparatus of the invention can be powered electrically in conventional manner, with a power supply of the type described in document WO 96/02966.

In general, the apparatus of the invention can operate at a voltage less than 12 kV, e.g. at a voltage lying in the range 6 kV to 12 kV for industrial applications that require high powers. For other applications, in particular home applications or consumer applications (and specifically to reduce peroxide compounds and ozone creation phenomena so as to generate not more than 0.01 ppm), a voltage of less than 6 kV may suffice, e.g. a voltage lying in the range 4.3 kV to 6 kV, or indeed a voltage of less than 4.3 kV, e.g. 4.2 kV.

In a particular embodiment, a high voltage power supply can be fixed on one of the plates 44 and 46, together with other electronic components enabling said plate to be powered directly.

Thus, the electronics and the needles are powered directly in uniform and permanent manner, thereby causing uniform high voltage to be emitted over the entire apparatus. A single check diode can then be integrated in the shell and the housing 48.

The voltage source thus feeds a single plate which receives all of the electronic circuit and equipment.

This integration provides very good isolation and very good safety for the apparatus relative to the external environment since it requires only one external connection, e.g. via an integrated "jack" type socket. It also makes it possible to eliminate the presence of any wire between the two plates, and to reduce the emission and diffusion of static charge. It thus contributes to a much improved production of ions. Finally, it makes it possible to reduce the overall size of the apparatus, and thus its surface areas in contact with the atmosphere.

Contact with mains can take place in uniform manner via one-piece units complying with European Union standards, delivering various types of voltage (in the range 6 V to 380 V), and adapting to various voltages and powers (e.g. 40 Hz to 60 Hz).

An integrated source of this kind can have an arbitrary number of emitter needles.

An example of a circuit developed for providing such integration of the high voltage power supply on one of the plates 44 and 46 is shown in FIG. 6. This circuit comprises a filter 70, an oscillator circuit 76, a transformer 78, and a set of voltage-multiplier stages 80. References 72 and 74 designate respectively a power supply control circuit 72 and a voltage regulator circuit (e.g. operating on 5 V) at the primary of the transformer.

In an embodiment, the apparatus is powered by an external voltage source lying in the range 10 V to 25 V, with the transformer delivering a voltage V1 that is approximately equal to 200 V, and with the multiplier assembly delivering a voltage V2 of about 5 kV.

In FIG. 2, the multiplier assembly 80 is represented diagrammatically on the plate 46, while the other electronic components integrated on this plate are not shown. The plate 46 is then an electronic circuit card, while the plate 44 is a plate for supporting the needles.

In another example, the bottom plate 44 supports the electronic circuit card assembly as well as the non-emitting bottom ends of the needles which are fixed thereto by soldering, for example, and also the sheaths of the needles. This embodiment is preferred over the embodiment in which the electronic circuit is located on the plate 46.

The second plate 46 is then offset from the plate 44 by at least 10 mm and by at most 14 mm, and it serves to improve the stability of the coaxial sheaths, and thus to improve the diffusion of electrons as emitted by the emitter points 40.2 of the needles 40. The face facing the first plate 44 is treated so as to be made insulating. It reinforces the mechanical support applied to the sheaths, for supporting the emitter needles/points. By way of example, the second plate 46 is made of a composite material whose inside face is insulating and whose top face is conductive and connected to ground (zero potential).

The electronic components used on the power supply card or plate can be of the surface mount component (SMC) type.

The plate on which the voltage source and the electronic components are integrated may have been dipped in a suitable standardized bath for potting the electronic assembly.

Overall, the housing that receives the electronic circuit, the electronic circuit cards, and the emitter needles/points, is preferably made of a material having very low electrical conductivity, and that produces very little static charge, e.g. a plastics material that is free from any trace of metal.

For use with humans or animals in close proximity, the material preferably has minimum resistivity of $10^4$ Ω.m, e.g. of $10^{12}$ Ω.m.

In general, the resistivity of this material preferably lies in the range $10^4$ Ω.m to $10^{12}$ Ω.m.

The selected material can be a K6 ABS polyamide material or an ABS polycarbonate. It can be treated with anti-ultraviolet and/or antistatic additives, e.g. by adding a filler either of talc (constituting more than 40%) or of glass, or of mica, or of a substance of mineral origin.

The material used preferably withstands a temperature greater than or equal to 120° C. Overall, the housing may be given internal treatment using an "antistatic" paint so as to reduce electric phenomena that produce static charge, which can be highly disturbing in the context of diffusing and emitting isotropically an intense flux of charge in the form of ions having one and/or the other sign, without emitting toxic compounds, and to do so at a moderate voltage.

The material constituting the housing can also be treated with additives that give it antistatic properties. In which case, additional treatment using antistatic paint is no longer necessary.

For ionizers having a large number of emitter points (e.g. more than 24 points), the housing is preferably made of a composite material that has been subjected to pultrusion.

As shown in FIG. 5, the housing 51 can be constituted by two shells which can be assembled together by means of two screw wells 56 (only one of which is shown in FIG. 5).

The housing can also serve to hold the electronic circuit cards and to support emitter needles/points. The two wells 56 are made of the same material as the two shells of the housing itself, and they can receive two screws 58, themselves preferably made out of a plastics material. After closure, the screws are inaccessible and the wells can be covered over, e.g. by a label. Such covering also serves to eliminate a possible source of micro-drafts, whose effects are already explained above.

By way of example, the screws can be 2.5 mm to 3 mm long, with the assembly wells 56 being about 5.8 mm to 6.5 mm deep.

Subdividing the housing into two distinct shells that are machined so as to have an assembly plane, and that are held together by screws as described above, is entirely compatible with industrial manufacture.

The apparatus can be provided with a grid 53 or a slot that allows electron flux to pass through and that performs a protective function. This grid or slot is preferably an integral part of the housing 51, as shown in FIG. 5, and is made out of the same material. It also serves to reduce air circulation in the immediate vicinity of the emitter end 40.2 of a point 40, thereby further reducing any production of peroxide type compounds.

Provision can be made to add a sedimentation collector to the housing that operates on any kind of dust and/or germs and/or particles that may become deposited by precipitation or sedimentation due to the action of the ionizer. By way of example, the collector can receive filters that can be changed or cleaned, or it can receive self-cleaning filters.

Because of the design of its sheaths, its needles, its assembly, and because of the design of its housing, the ionizer apparatus of the invention makes it possible to raise the number of needles to 24 or greater (e.g. 48, 96, or 192 points). This makes it much easier to treat large volumes, with the additional advantage of ion emission that is of good quality, without peroxide compounds being created, and without any flow of static charge.

In another aspect of the invention, the ion diffusion obtained by an ionizing apparatus, and in particular an apparatus of the invention as described above, can be monitored by means of an ion tester which serves to perform measurements occasionally or in integrated manner via a secondary connection, e.g. using a connection integrated in the apparatus.

Furthermore, for an installation in given premises with a given environment, it is possible to calculate an ideal volume of ions that needs to be produced.

To this end, a total corrected volume of the premises is calculated taking account not only of the real volume of the premises, but also of one or more parameters including:

- the nature of the ground or floor (Ns), and/or of the ceiling (Np), and/or of the walls (Nm) of the premises; and/or
- the presence or absence of an air conditioning system (Cl), and/or of a ventilation system (V), and/or a heater system (Ch); and/or
- the presence of furnishing (M); and/or
- the geographical situation (S) of the premises; and/or
- the presence in the premises of a photocopier and/or a television set (T) and/or a Minitel (Mi) and/or a computer (O) and/or a hi-fi system (Hf) and/or a facsimile type transceiver system (F); and/or
- the presence in the premises of people (Pe) and/or of animals; it is also possible to draw distinctions depending on whether or not the people are smokers (Fu).

In a first embodiment, it is possible to use the following formulae:

$$P=Ns+Np+Nm+Cl+V+Ch+M+S \quad (1)$$

$$A=T+O+Hf+F+6\times Pe+6Fu \quad (2)$$

where the various parameters have the values given in the tables below.

TABLE II

| Nature of the floor | |
|---|---|
| Ns = 0 | Tiles and/or bare boards |
| Ns = 10 | Carpet (fitted or otherwise) |
| Ns = 5 | Plastics tiles and/or linoleum |
| Ns = 5 | Agglomerated media |
| Ns = 0 | Other |

TABLE III

| Nature of the ceiling | |
|---|---|
| Np = 0 | Plaster and/or paint and/or smooth wallpaper |
| Np = 10 | Polystyrene slabs |
| Np = 10 | Tensioned cloth |
| Np = 0 | Other |

TABLE IV

| Nature of the walls | |
|---|---|
| Nm = 0 | Paint and/or smooth wallpaper |
| Nm = 10 | Wall cloth and/or wall carpet |
| Nm = 5 | Hangings and/or curtains |
| Nm = 0 | Windows |
| Nm = 0 | Other |

TABLE V

| Air conditioning | |
|---|---|
| Cl = 0 | No |
| Cl = 25 | Yes |

TABLE VI

| Ventilation | |
|---|---|
| V = 0 | No |
| V = 25 | Yes |

TABLE VII

| Television and/or photocopier | |
|---|---|
| T = 0 | No |
| T = 10 | Yes |

TABLE VIII

| Computer | |
|---|---|
| O = 0 | No |
| O = 20 | Yes |

TABLE IX

| Minitel | |
|---|---|
| Mi = 0 | No |
| Mi = 5 | Yes |

TABLE X

| Kind of heating | |
|---|---|
| Ch = 10 | Underfloor electric |
| Ch = 20 | Gas or wood or coal or oil fire |
| Ch = 0 | Central heating or electric radiators |
| Ch = 0 | Other |

TABLE XI

| Nature of furniture | |
|---|---|
| M = 0 | Wood |
| M = 10 | Metal (surface area 100%) |
| M = 8 | Metal (surface area 80%) |
| M = 6 | Metal (surface area (60%) |
| M = 4 | Metal (surface area 40%) |
| M = 2 | Metal (surface area 20%) |
| M = 0 | Plastics materials |
| M = 0 | Other |

TABLE XII

| Environmental situation | |
|---|---|
| S = 0 | In the mountains, in the country, in the forest, or at sea |
| S = 10 | Town and/or industrial zone |
| S = 20 | Highly polluted town <BR> |
| S = 20 | Next to a motorway or close to a junction <BR> |
| S = 10 | Close to an airport <BR> |
| S = 20 | Close to a chemical complex |

TABLE XIII

| Number of people | |
|---|---|
| Pe = 0 (?) | More than 2 people |
| Fu = 0 (?) | Total number of smokers |

After applying above formulae (1) and (2), the total corrected volume is calculated using the following formula:

$$V_t = V_p + (1 + P/100) + A$$

where $V_p$ represents the real physical volume of the room or the premises (length×width×height).

When $V_p$ is expressed in $m^3$, then $V_t$ is obtained in $m^3$. Each of the coefficients given above adds a certain is amount of volume to the real physical volume $V_p$. For example, the presence of air conditioning makes it necessary to add 25/100=0.25 $m^3$ to $V_p$, whereas the presence of a single person requires 6 $m^3$ to be added to $V^P$.

Calculated $V_t$ thus gives a corrected volume. The ion generator apparatus produces a certain quantity of ions that is matched to a certain volume, as a function of the applied voltage. This data is given, for example, by the manufacturer of the ionizer. The description below relates to an example in which $4\times10^{12}$ negative ions are emitted per second for treating on average a volume of about 80 $m^3$ to 100 $m^3$ of air.

Once $V_t$ has been calculated, the applied voltage can be varied, thus varying the volume of ions actually produced, so as to match production to environmental conditions.

The example of a regulation system is shown in FIG. 7. In this figure, reference 81 designates an ionizer apparatus including one or more emitter points 85, 86, 87.

The calculations described above can be performed separately, e.g. on a portable microcomputer 96 running an appropriate program; it can also be performed remotely, with the program then being loaded on a server 90 to which the user establishes a connection via a network 98.

Finally, calculation can be performed directly by a microprocessor 94 designed and programmed specifically to calculate $V_t$ and possibly also P or A.

In any event, the user supplies data either to the microcomputer 96 or to the apparatus 94 concerning the various parameters, either in the form of answers to questions, or else directly in the form of quantified parameters. Under such circumstances, the user already has available in the form of a table or in a memory of the microcomputer 96, the data specified above.

The apparatus 94 then compares the data supplied by the ion measurer 82 with the volume of ions required, itself deduced from $V_t$, and depending on the result of this comparison, it issues a voltage comparison signal. By way of example, the apparatus may include a voltage varying unit acting on the basis of the emitter points/needles, amongst other things. This can be a pushbutton having three positions corresponding to maximum use, intermediate use, and minimum use, or to a control knob having no scale but serving the same function. Matching and incorporation can also take place in the transformer primary, or in a transistor provided for this purpose.

In a variant, a plurality of individual ionizers are disposed in a single premises, and as a function of the result of the comparison, one or more additional ionizers are either activated or stopped.

Finally, in another embodiment, the user calculates the volume $V_t$, e.g. by using the microcomputer 96, and then adjusts, by hand, the operating voltage of the ionizer or the number of ionizers in operation.

The rate at which ions are produced can thus be modulated as a function of user requirements, e.g. on the basis of data supplied by the manufacturer of the apparatus.

Figure 8:
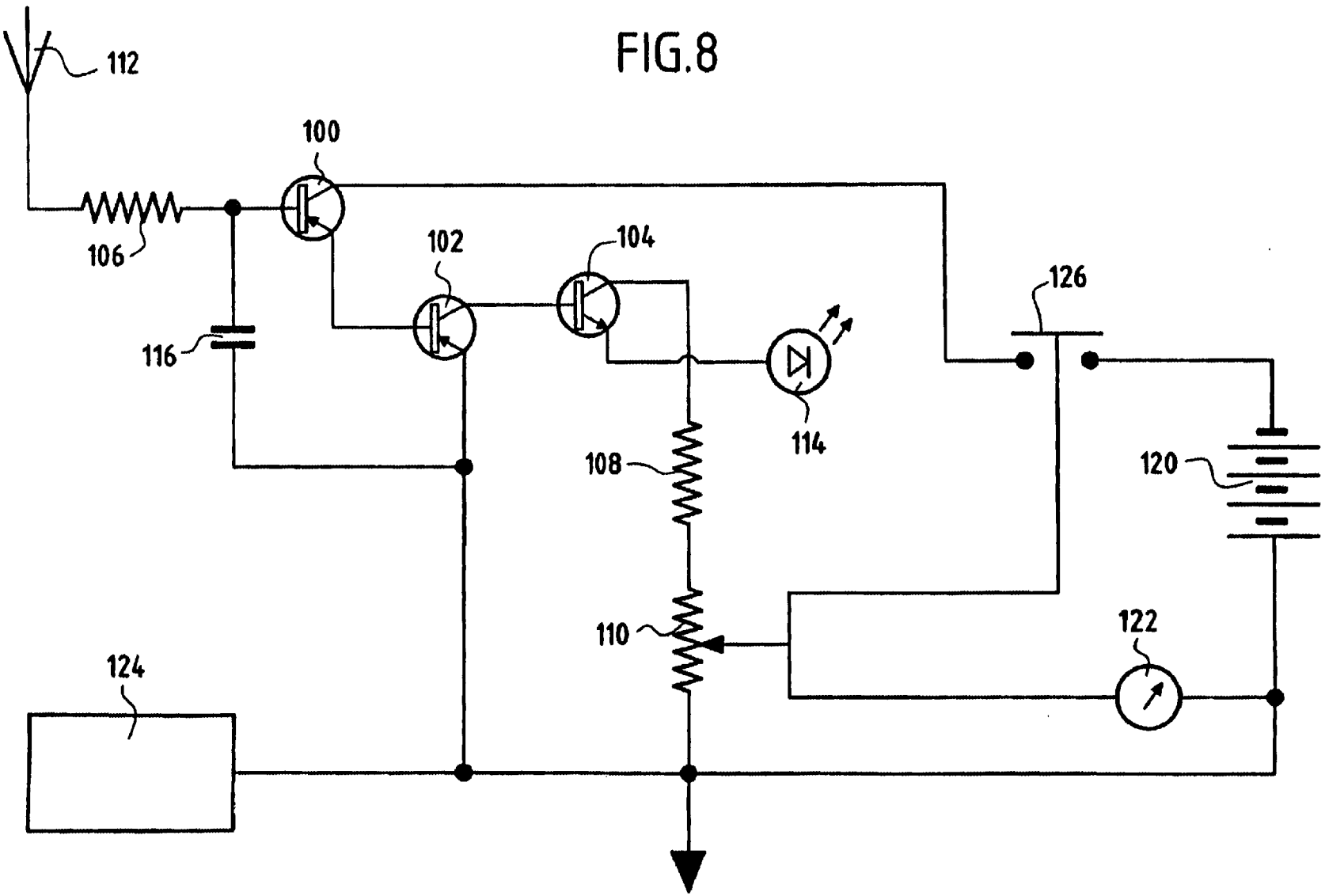
FIG. 8 is a diagram of a circuit for measuring ions.

An example of an ion measuring unit suitable for use as the measurer 81 is shown in FIG. 8. It has three transistors 100, 102, and 104, three resistors 106, 108, and 110, an antenna 112 (used as a sensor), a light-emitting diode 114 (LED), and a switch 126.

Ions collect on the antenna, thereby giving rise to small negative current I1 passing through the base of transistor 100. A capacitor 116 co-operates with a resistor 106 to form an RC network that eliminates any rapid fluctuation.

When I1 is large enough, the transistor 100 trips. The negative terminal of the battery 120 is connected to the base of the transistor 102 which is thus biased and conducts in turn.

The base of the transistor 104 is associated with the positive terminal of the battery. When 104 is biased, its collector is in series with the current limiting resistor 108 and the potentiometer 110, thereby giving rise to conduction.

When 108 is engaged, a meter 122 (e.g. a meter for measuring 100 mA) indicates (in non-linear manner) the relative level of the ion flux, and the diode 114 (in series with the emitter of 104) lights up to indicate that ions are present.

In order to prevent any static charge being produced, the circuit is enclosed in a plastics housing (e.g. made of an ABS composite obtained by pultrusion) that is filled with up to 45% of talc or mica. A 1.25 cm side aluminum strip is fixed on the side of the housing and it is connected to the circuit at the junction between the capacitor 116 and the positive terminal of the battery 120. This aluminum strip acts as a ground point for the circuit. It could be replaced by a connection to a fixed ground point.

The above-described circuit detects negative ions. By reversing the polarity of the transistors (changing NPN to PNP, and vice versa), it is capable of detecting positive ions.

By way of example, the transistors 100 and 102 are standard PN 2907 type PNP transistors, the transistor 106 is a standard PN 2222 type NPN transistor, the resistors 106 and 108 have respective resistances of 100 MΩ and 10 kΩ, the potentiometer 110 has a resistance of 5 kΩ, the capacitor 116 has a capacitance of 470 pF, and the battery 120 is a 9 V radio battery.

The switch 126 is associated with the potentiometer 110. It is also possible to use a potentiometer incorporating a switch.

The ion measurer as described above enables the presence of ions in the air or atmosphere to be detected and gives the relative concentration thereof.

This ion measurer can be used to regulate the production of ions, as shown in FIG. 7. It also makes it possible to check ion leaks or to test for static charge (e.g. on clothes or on neon tubes or on plastics containers) and it can therefore be used independently of the circuit shown in FIG. 7.

The apparatus of the invention serves to restore ion equilibrium and to restore premises or a site to health.

It can be applied in a very wide variety of fields, both at home and in industry.

Examples of particularly advantageous applications relate to the food industry (all kinds of animal husbandry) or to conserving food (refrigerators and refrigerated chests whether fixed or moving, portable or otherwise). The invention applies in particular to the field of vacuum conservation, by replacing chlorine based treatments, and also to the field of conserving substances in general. It applies in particular to conserving so-called "category 4" produce, agricultural produce, preserved fish and seafood.

Other applications relate to air conditioning, ventilation, and ventilation of horizontal or vertical dwellings, whether centralized or individual, office sites or centers, computer centers, clean rooms, public or private hospital premises, pharmaceutical sites, gray and white airlocks in industry, pharmaceuticals, hospitals (public or private), and in general any laboratory, day nursery, or retirement home.

It is also applicable to vehicles for transport on land, by air, on rail, or at sea. It is appropriate to mention applications relating directly to human and animal life, for treating respiratory ailments, or allergies, whether they be of atmospheric or other origin.

The apparatus can also be used for treating problems and phenomena associated with infections, quartz silica, asbestos, mites, and to the distribution of bacterial or viral emissions via direct or indirect paths in the atmosphere.

It also makes it possible to treat and have influence over phenomena associated with static charge disturbances or electromagnetic fields.

The apparatus of the invention also makes it possible to produce ions while avoiding creating or producing various peroxide type compounds that are harmful to human life, in enclosed or semi-open surroundings, and/or toxic productions or emissions harmful to human life in closed or semi-open enclosures, such as ozone ($O_3$) or nitrogen oxide ($NO_x$) or carbon monoxide, or other derivatives.

Furthermore, the regulation method implemented in combination with the apparatus of the invention enables ion equilibrium to be restored and enables any premises to be restored to healthy conditions by evaluating the amount of ion emission that is required as a function of the installation of equipment, in order to treat the air of the site or the enclosure fitted with the apparatus of the invention.

In particular, it is thus possible to distribute ion production as estimated and calculated for the purpose of restoring the atmosphere of the intended premises to healthy conditions in a manner that is uniform and/or localized, on manual or remote control, in continuous or intermittent manner, and in almost perfectly isotropic manner, to comply with predetermined requirements.

More detailed examples of applications are given below.

EXAMPLE I

A first example concerns a study on the effectiveness of the ionizer in a gray airlock for loader personnel (in a unit in the pharmaceutical industry).

As described above, the apparatus used is capable of emitting $4\times10^{12}$ negative ions per second, thus enabling it to process on average 80 $m^3$ to 100 $m^3$ of air The apparatus was placed in the gray airlock for loader personnel. A high level of microbial contamination of the air had been observed in the airlock, over a period of several weeks.

Tests were performed before the ionizer was installed, and while the ionizer was in use.

Particular tests were performed using a METONE 217 type particle counter, serial number 92 22 51 47 MM, fitted with an isokinetic probe. Tests were performed during periods of activity. That applies to particle testing.

In addition, bacteriological tests were performed. Tests were applied to ambient air and to surfaces (wash-basins and floors). Tests were performed in the same manner as routine sampling during operation of the apparatus, using an RCS for ambient air and "all contact" type agarose for the surfaces.

With particle results, a comparison of the averages taken indicates that the results are meaningful.

A drop in particulate activity was observed during operation of the apparatus. Over about 150 measurements, activity for 0.5 micrometer particles went from 674 to 120 on average; and for 5 micrometer particles from 19 to 6 on average, thus:

activity was reduced by 82% for particles of size greater than 0.5 micrometers; and by 68% for particles of size greater than 5 micrometers.

In addition, it was observed that the maximum number of particles counted before using the ionizer was 15,543 for particles of size greater than or equal to 0.5 micrometers. It was 201 for particles of size greater than or equal to 5 micrometers.

With the ionizer in operation, these maxima were no greater than:

2022 for particles greater than 0.5 micrometers; and

112 for particles greater than 5 micrometers. There was thus indeed a reduction in particle activity.

For bacteriological results, a comparison of averages demonstrates that the results are meaningful.

A large drop in the microbial contamination of the general air was observed: the average went from 660 germs/$M^3$ to about 130 germs/$m^3$, i.e. a decrease of 80%.

The percentage of measurements in excess of limits for general air in the gray airlock went from 68.5% to 20%.

It would appear that microbial contamination was greatly reduced while the apparatus was in operation.

Consequently, the ionizer apparatus of the invention is effective in reducing particulate activity and in reducing contamination of the air in general, even if it does not eliminate them completely. Although described above for a pharmaceutical production unit, it could equally be applied in a manner that is just as advantageous to a computer equipment room.

EXAMPLE II

This example relates to the effect of an ionizer in a delivery room.

The volume treated was 1200 $m^3$ and seven apparatuses of the invention were installed in the room.

Tests were performed by a biological hygiene technician when the room was at rest without any human presence, on Apr. 9, 1998 (day D0 prior to equipment being installed) and on April 10 and Apr. 11, 1998 (respectively days D1 and D2).

The particle counting apparatus used was of the "MET ONE 227" type having a flow rate of 2.8 liters per minute, with samples being taken over a duration of 1 minute. That apparatus was installed in the middle of the room.

Measurements of biological contamination of the air were performed using an apparatus of the "SAMPL'AIR" type at a flow rate of 100 liters per minute with samples taken over a period of 10 minutes. That apparatus was likewise installed in the middle of the room.

The results of particle counting and of performing microbiological tests on surfaces, and of testing air for biological contamination are summarized in the following tables respectively.

TABLE XIV

| | Number of particles/$m^3$ | | |
|---|---|---|---|
| | D0 | D1 | D2 |
| Particles $\geqq 0.5\mu$ | 2,560,607 | 1,507,857 | 887,286 |
| Particles $\geqq 5\mu$ | 19,821 | 15,214 | 6,643 |

TABLE XV

| | Microbiological testing of surfaces: number of germs/25 $m^3$ | |
|---|---|---|
| | D0 | D2 |
| Ground | 10 | 3 |
| Ground | >250 | 0 |
| Mattress | 9 | 3 |
| Technical strip | >250 | >250 |
| Shelf | cloth | 200 |

TABLE XVI

| | Air biological contamination | | |
|---|---|---|---|
| | D0 | D1 | D2 |
| PNC/$m^3$ | 56 | 17 | 14 |

The results on D1 and D2 show a clear reduction:

in particle content; and number of PNC/$m^3$.

The results on D2 concerning surface contamination do not confirm these conclusions. We do not know whether the tests were performed under the same conditions of biological cleaning.

EXAMPLE III

This example relates to treating the air in a loose box housing a race horse or show jumper.

A race horse spends more than 20 hours per day in its loose box, which constitutes a housing occupying about 3.5 meters by 3 meters on the ground. In theory it is cleaned out every day, early in the morning, and it is a location where a large amount of dust and germs concentrate.

Various horses presenting different ailments were placed in a loose box fitted with ionizers as described above. More precisely, the examples given below relate to horses having persistent coughs, symptoms of epistaxis, and symptoms of poor form.

Firstly, three horses were observed, all three of which had persistent coughs on leaving their loose boxes in the morning.

Those horses had already received all of the medication normally employed under such circumstances. All three of them were vaccinated against equine flu and rhinomneumonitis, more frequently than required by racing regulations and the frequencies specified by the suppliers.

It was found that when an apparatus of the invention was used in a loose box, coughing disappeared and, after 3 weeks, clinical symptoms had completely disappeared.

When the apparatuses were switched off, in order to be able to take samples of the dust fixed on the needles, cough symptoms reappeared in a few days. Thereafter, they disappeared again when the horse was put back in the presence of the apparatus.

For symptoms of epistaxis, it would appear that negative ions reinforce the tone of the ciliated cells of the bronchus and bronchioli.

It also appears that they increase the resistance of the alveolar cells.

Bleeding phenomena due to weakness of the alveolar cells were observed to regress and disappear on a horse which had been put into the presence of the apparatus because of a cough.

In a study concerning behavior, a perfectly healthy stallion suffering from claustrophobia was kept in a loose box in the presence of an apparatus of the invention. Normally, that horse had for a long time shown signs of continuous agitation in his loose box.

Within a few weeks, the behavior of the stallion had been improved enormously. He was no longer agitated in his loose box. The same could be observed with horses in training and under treatment.

As for their form, it was observed that the performance of race horses was improved on specific occasions.

The various observations recounted above show that apparatus of the invention can be highly effective in the living quarters of a horse. It can also be applied advantageously to a vehicle for transporting animals, e.g. the horse.

In general, the apparatus of the invention can also be used most effectively in the living quarters of any animal, and in particular of chickens, ducks, turkeys, or rabbits.

The invention thus also applies to animal living quarters fitted with ionizing apparatus as described above, e.g. a cage made of plastics material (or polymer or composite) fitted with such an ionizer, e.g. for chickens, for ducks, for turkeys, or for rabbits or for other small animals (dogs, cats, . . . ).

EXAMPLE IV

This example relates to treating the air in a pig unit, where the air was treated by using ionizing apparatus of the invention.

Measurement operations were performed on two pig breeding and fattening sites.

On the first site, the production cycle was based on three weeks:

a first week in which the sows were served;

a second week in which the sows farrowed; and a third week in which the piglets were weaned, at 28 days.

That type of production makes it possible to compare results obtained in a treated unit with results obtained in a non-treated unit for the same cohort.

The second site had a production working cycle on a weekly basis. Each week sows were served, or farrowed, and weaned took place at 21 days.

This second type of production was not suitable for comparing results obtained in other units at the same moment, and they could only be compared with results obtained on previous cohorts at the same stages of production.

First Production Site

Air treatment strips or apparatuses of the invention were installed on Aug. 31, 1998 in the farrowing unit.

The operation was terminated on Sept. 28, 1998.

The unit felt better, but no significant health result could be attributed to the treatment performed.

The suckler unit was also fitted with apparatuses of the invention. The unit felt better and a reduction in smell was observed.

Direct technical results were good since a significant increase in weight was observed over a short duration (not more than 21 days) with this taking place over a period that is highly sensitive (weaning, loss of mother, change of context, . . . ).

The difference compared with figures for the four preceding cohorts show how great the differences are, since it can be seen that the total increase in weight per piglet was 810 grams (g) and that the mean daily weight gain (DWG) per animal was 49 g.

Furthermore, a reduction in coughs and sneezes was observed which makes it likely that health was better and respiratory capacity was better.

In the post-weaning stage, on 146 piglets, a mean finishing weight of 34.430 kg was observed for a mean age of 74.9 days and a DWG of 519 9. The farmers' qualitative assessment of the batch was good: the batch was generally uniform:

the pigs were uniform; and their growth was regular.

The results of the various tests are summarized in comparative Table XVII below:

TABLE XVII

| | Mean of four preceding batches | | Mean of four succeeding batches |
|---|---|---|---|
| FARROWING | | | |
| Live births per sow | 10.9 | 12.6 | 11.6 |
| Weaned per sow | 9.7 | 9.7 | 9.8 |
| Weight | 6.2 kg | 6.3 kg | 6.0 kg |
| Age | 20.9 d | 20.7 d | 20.4 d |
| SUCKLING | | | |
| Number | 590 | 146 | 571 |
| End weight | 10.69 kg | 11.50 kg | 11.36 kg |
| Age | 45.6 d | 43.9 d | 46.4 d |
| Deaths | 3 | 0 | 5 |
| DWG | 178 g | 227 g | 207 g |
| WEANING | | | |
| Number | | 146 | |
| End weight | | 34.43 kg | |
| Age | | 74.9 d | |
| Deaths | | 0 | |
| DWG | | 519 g | |

Second Production Site

In this second site, a farrowing unit had ionizer apparatuses installed on Sep. 1, 1998 and the sows were admitted on Sep. 3, 1998.

There were units subject to ionization treatment (with 23 sows per unit) and units that were not treated (with 24 sows per unit).

The technical results are summarized in Table XVIII below.

TABLE XVIII

| | Treated units | Non-treated units (reference unit) |
|---|---|---|
| Live births | 12.8 | 12.7 |
| Retained | 12.3 | 12.4 |
| Weaned/sow | 11.6 | 11.4 |
| Weight | 7.6 kg | 7.5 kg |
| Stillbirths | 0.8 | 0.8 |

From the health point of view there is nothing to be mentioned that demonstrates any particular change that can be attributed to treating the air.

The suckler unit was fitted on Oct. 7, 1998 and the animals admitted on Oct. 8 or 9, 1998. The results relate to 528 piglets weaned at 27 days. The technical results are given in Table XIX below.

TABLE XIX

| | Treated units | Non-treated units (reference unit) |
|---|---|---|
| Mean weight | 7.410 kg | 7.460 kg |
| weight at 20 days | 14.30 kg | 14.20 kg |

TABLE XIX-continued

| | Treated units | Non-treated units (reference unit) |
|---|---|---|
| DWG | 344 g | 337 g |
| Deaths | 0 | 0 |

From the health point of view, there is nothing to mention concerning coughs and sneezes.

The elements summarized do not appear to show up any meaningful trend or interpretation.

A second measurement operation was performed in the suckler unit on Oct. 27, 1998.

The results relating to the treated unit have had removed therefrom the results of a pen containing the runts. The specific nature of that pen penalizes the overall results established on 11 standard pens.

The technical results are summarized in Table XX below.

TABLE XX

| | Treated unit | Reference unit | Difference ± | Results of three batches |
|---|---|---|---|---|
| Piglets | | | | 1,578 piglets |
| DWG | 416 g | 364 g | +52 g | 371 g |
| Average weight | 15800 kg | 14680 kg | +1.120 kg | |

More gray scouring was observed in the treated unit than in the reference unit, but without any particular explanation (feed and temperature was the-same). Without these various additional cases, doubtless a better DWG difference would have been observed.

From the technical point of view, in practice the same very good results are to be found as those obtained in the first site.

The tests performed in the two sites show that it is advantageous to ionize air when housing livestock. In general, the treated units felt better: there were fewer polluting factors for the animals, and also for personnel working in the units.

EXAMPLE V

This example relates to using ionizer apparatuses of the invention in the food industry.

The main lines of the studies performed related to three potential applications of ionizers in the food industry:

atmosphere decontamination;

surface decontamination; and storing foodstuffs.

For decontaminating surfaces, the tests performed appear to show that ionizer apparatuses do not have any effect on surfaces.

As for atmosphere decontamination, tests were performed in a room for preparing foodstuffs that had a volume of 80 $m^3$.

That room stimulated a workshop for producing foodstuffs and had the following specific characteristics:

flows of people and of materials;

the presence of numerous items of equipment made of stainless steel; and periods of cleaning and of disinfection.

Tests were performed using ionizers of the invention, with microbe load being tracked by monitoring using a Petri dish (with a non-selective PCA type medium).

Preliminary tests were performed in the premises without the ionizing apparatus. The microbe load increased very significantly during periods of activity. This increase in contamination appeared to be related particularly:

to the number of people working in the workshop;

to the raw materials used;

to the flow of material and labor; and to environmental conditions (temperature or humidity).

A first series of tests served to test the effectiveness of one to four ionizers in the premises.

An out-of-test week without using an ionizer apparatus was applied prior to each change of conditions under study.

The ionizers were placed at the same location on the wall, remote from the suction hood.

The results are summarized in Table XXI below.

TABLE XXI

| Week | Number of ionizers in operation |
|---|---|
| 1 | 0 |
| 2 | 1 |
| 3 | 0 |
| 4 | 2 |
| 5 | 0 |
| 6 | 4 |

In weeks 1 to 2 and 3 to 4, no difference was observed between the reference and the test.

In weeks 5 and 6, a trend was observed towards baterial load decreasing more quickly after activity.

A very limited effect of the ionizer apparatuses was observed on the microbe load. Outside periods of activity, there was observed a trend towards atmospheric contamination decreasing more quickly. An accumulation of particles forming a black deposit was also observed around the ionizer apparatuses. A second series of tests was performed. During the second series, the disposition of the ionizer apparatuses was changed: they were placed on the walls of the premises.

It was then possible to observe that they had an effect of capturing microparticles in the air, but no bactericidal effect could be found.

In terms of storing foodstuffs, tests were performed on foodstuffs stored in an enclosure at +4° C., with or without ionizer apparatus.

It was observed that the color of beef had better stability, as measured using a Minolta color meter. Better color stability was also observed with certain fruit (bananas, tomatoes), over a duration of 72 hours.

It would also appear that the pH of tomatoes stored under an ionized atmosphere was stabilized.

EXAMPLE VI

This example relates to the use of ionizer apparatuses of the invention and to the emission of negative ions for preserving fresh fish.

The tests were performed on sardines and on smelt.

An ionizer of the invention was inserted into a refrigerated enclosure (enclosure 1) maintained at 4° C. with mean humidity of 75%. The ionizer was installed 1 day before the beginning of tests.

Another refrigerated enclosure (enclosure 2) having the same volume and maintained under the same conditions of temperature and humidity was not provided with ionizing apparatus.

Ten fishes were used for the tests.

They were purchased immediately before the experiment, preserved on ice, and then cut in two.

One-half of each fish was then placed in enclosure 1 and the other half in enclosure 2. The fish halves were kept in this way for 5 days without taking action.

A first test (a chemical test) was performed.

The kit used (TRANSIA "Fresh tester FTP II" (FT302)) serves to determine the freshness of the fish.

The kit serves to measure the total quantity K of products of ATP degradation:

$$K\ (\%) = \frac{H_xR + H_x}{ATP + ADP + AMP + IMP + H_xR + H_x} \times 100$$

In the numerator of this expression, $H_xR+H_x$ represents the quantity of inosine ($H_xR$) and of hypoxanthine ($H_x$) resulting from the decomposition of ATP (adenosine triphosphate). In the denominator, there are to be found in succession the quantities of ATP, of adenosine diphosphate (ADP), of adenosine monophosphate (AMP), and of inosine monophosphate (IMP), together with the quantities of $H_xR$ and $H_x$.

K is inversely proportional to the freshness of the fish.

The kit is in the form of a tube of test-strips, an extraction buffer flask, and a chart for reading K.

A sample of dorsal muscle from a fish under test was taken, without any skin, and a quantity of buffer was added thereto. An extract was taken from the resulting mixture and a test strip was immersed therein.

The tests performed on the fishes stored as described above show that degradation of the fish halves in enclosure 1 was slowed down.

In particular, sardine pieces from enclosure 1 were 10% to 25% less degraded than those from enclosure 2.

Smelt pieces from enclosure 2 were 10% to 20% more degraded than those from enclosure 1.

A second test (a test based on the senses) was performed.

This test was more subjective, but it could clearly be observed that fish stored under ionization was in a better general state (better appearance, less odor, fresher texture, significantly less drying and hardening of the flesh).

These tests show that fresh fish, or seafood in general, can be preserved better by using ionizer apparatus of the invention.

The number of ionizers to be used and the rate at which negative ions should be produced depend on the volume of the storage enclosure and on the mass of fish to be preserved.

The invention thus also provides a method of storing food, in which method the food is conserved in an enclosure provided with one or more ionizer apparatuses of the invention. In particular, it is possible to provide chests or refrigerated chests or cold chambers or refrigerators or display windows or refrigerated display windows provided with ionizer apparatuses, and preferably ionizer apparatuses of the invention.

EXAMPLE VII

Apparatus of the kind described above can, in accordance with the invention, also be applied to producing vacuum-packed foodstuffs.

Heretofore, vacuum packaging has consisted in causing the foodstuff to pass along a tunnel or other system, and in treating it with chlorine-containing substances for preservation purposes. Thereafter the foodstuff is vacuum-packed.

In the invention, treatment by oxygen ions $O_2$— advantageously replaces treatment by chlorine-containing substances.

The foodstuff is thus conveyed by a belt or other system to a tunnel having ionizer apparatuses of the invention installed therein. The production of $O_2$— ions therein can be regulated by a system of the type described above with reference to FIG. 7. After that, packing operations are performed in the presently known manner.

What is claimed is:

1. Apparatus for generating ions in a gaseous medium, comprising:

at least one needle (40, 85, 86, 87), each said needle presenting a shank (40.1) and an emitter end (40.2);

a sheath (42) of composite material comprising a glass fiber reinforced unsaturated polyester surrounding the shank (40.1) of each needle, said composite material having a resistivity of $10^4$ to $10^{12}$ Ω·m; and means (44, 46, 70, 72, 74, 76, 78, 80) for applying a voltage between two portions of the shank of each needle.

2. Apparatus according to claim 1, in which the sheath (42) is of cylindrical outside shape.

3. Apparatus according to claim 1, in which the one or more needles are made of a material selected from the group consisting of: titanium, platinum, a compound of titanium and platinum, silver, stainless steel, brass, nickel, and an alloy of these materials.

4. Apparatus for generating ions in a gaseous medium, comprising:

at least one needle (40, 85, 86, 87), each said needle having a shank (40.1) and an emitter end (40.2), each needle being made of a material selected from the group consisting of titanium, platinum, and a compound of titanium and platinum;

a sheath (42) of composite material comprising glass fiber reinforced unsaturated polyester which surrounds the shank (40.1) of each needle; and means (44, 46, 70, 72, 74, 76, 78, 80) for applying a voltage between two portions of the shank of each needle.

5. Apparatus according to claim 1, in which each emitter end (40.2) is covered in a film of gold.

6. Apparatus according to claim 1, in which the composite material has a glass content lying in the range 50% to 90% by weight relative to the total weight of the material.

7. Apparatus according to claim 1, in which the composite material also includes mica.

8. Apparatus according to claim 1, in which each needle (40) is held firmly in the sheath (42) which surrounds it without any possibility of rubbing or displacement.

9. Apparatus according to claim 1, in which the means for applying a voltage between two portions of the shank of each needle comprise first and second plates (44, 46) situated at two different heights along each sheath of composite material, and means (70, 72, 74, 76, 78, 80) for applying a high voltage between said two plates.

10. Apparatus according to claim 9, in which one of the two plates (44) forms a support for each needle (40) which is held firmly without rubbing.

11. Apparatus according to claim 10, in which one of the two plates is provided with an integrated high voltage source (70, 72, 74, 76, 78, 80).

12. Apparatus according to claim 11, in which the integrated high voltage source has means for producing a first voltage (V1), and means for multiplying said first voltage so as to obtain the desired high voltage (V2).

13. Apparatus according to claim 11, in which the high voltage source is made using surface mount components (SMCs).

14. Apparatus according to claim 1, having a plurality of needles, each needle being surrounded by a sheath, the sheaths being interconnected in pairs.

15. Apparatus according to claim 14, in which the sheaths are coupled together in pairs by means of webs (60) of material identical to the material of the sheaths.

16. Apparatus according to claim 15, in which the two sheaths and the plate of a pair are formed as a single unit.

17. Apparatus according to claim 1, in which the apparatus is incorporated in a housing (51) made of plastics material.

18. Apparatus according to clam 17, in which the plastics material has all traces of metal removed therefrom.

19. Apparatus according to claim 4, in which the plastics material has resistivity lying in the range $10^4$ Ω to $10^{12}$ Ωm.

20. Apparatus according to claim 17, in which the inside of the housing is treated with antistatic paint.

21. Apparatus according to claim 17, in which the material constituting the housing is treated with additives implanting antistatic properties thereto.

22. Apparatus according to claim 17, in which the housing comprises two shells with screw wells (56).

23. Apparatus according to claim 22, further including means for closing the screw wells (56) after the two shells have been assembled together.

24. Apparatus according to claim 1, further including regulator means (82, 94) for regulating the voltage applied between the two portions of the shank of each needle.

25. Apparatus according to claim 24, in which the voltage regulator means comprise means (82) for measuring the quantity of ions produced by the apparatus, means (94) for comparing said quantity of ions produced with an ideal quantity of ions required, and means for varying the applied voltage as a function of the result of the comparison between the quantity of ions produced and the quantity of ions required.

26. Apparatus according to claim 25, in which the ideal quantity of ions required is determined on the basis of a corrected volume which takes account of the real volume of the premises in which the ion generator apparatus is installed, and also of the content of the premises and/or its surroundings.

27. Apparatus according to claim 24, in which the means for varying the applied voltage are automatic means or manual means.

28. Apparatus according to claim 25, including an ion detector, itself comprising:

means (112) for sensing ions or a quantity of ions in an atmosphere;

indicator means (114, 122) for indicating the presence of ions; and switch means (100–110) for switching the indicator means as a function of the quantity of ions sensed by the ion sensor means (112).

29. Apparatus according to claim 28, in which the-switch means (100–110) comprise a transistor (104) biased by a voltage source when switching occurs.

30. A method of vacuum-packaging foodstuffs, the method comprising the steps of:

producing one or more negative oxygen ion fluxes by means of apparatus according to claim 1;

subjecting the foodstuffs for packaging to said ion flux; and vacuum-packaging the foodstuffs.

31. A method of storing foodstuffs in which the foodstuffs are placed in premises fitted with ionizer apparatus according to claim 1, and in which a flux of negative ions is produced by means of said ionizer apparatus.

32. A method of storing foodstuffs according to claim 31, in which the foodstuffs are meat or fish or vegetables.

33. A method of treating the atmosphere in premises, comprising generating said ions with an apparatus according to claim 1.

34. A method according to claim 33, in which the premises is a gray or white airlock, or a clean room, or a computer room, or a room fitted with computer or electronic equipment, or a hospital ward or theatre.

35. A method according to claim 33, in which the premises is a unit in which animals are reared.

36. A method according to claim 33, in which the premises is a zone or workshop for producing food.

37. Apparatus for generating ions in a gaseous medium, comprising:

at least one needle (40, 85, 86, 87), each said needle presenting a shank (40.1) and an emitter end (40.2);

a sheath (42) of composite material comprising a glass fiber reinforced unsaturated polyester surrounding the shank (40.1) of each needle, said composite material having a resistivity of $10^4$ to $10^{12}$ Ω·m, said sheath being of cylindrical outside shape without conical structure; and means (44, 46, 70, 72, 74, 76, 78, 80) for applying a voltage between two portions of the shank of each needle.

38. Apparatus for generating ions in a gaseous medium, comprising:

at least one needle (40, 85, 86, 87), each said needle having a shank (40.1) and an emitter end (40.2), each needle being made of a material selected from the group consisting of titanium, platinum, a compound of titanium and platinum, silver, stainless steel, brass nickel, and an alloy thereof;

a sheath (42) of composite material having a resistivity of $10^4$ to $10^{12}$ Ω·m comprising glass fiber reinforced unsaturated polyester which surrounds the shank (40.1) of each needle, the composite material having a glass content of 50 to 90% by weight, and the sheath being of cylindrical outside shape without conical structure; and means (44, 46, 70, 72, 74, 76, 78, 80) for applying a voltage between two portions of the shank of each needle.

* * * * *

UNITED STATES PATENT AND TRADEMARK OFFICE

CERTIFICATE OF CORRECTION

PATENT NO. : 6,735,830 B1
DATED : May 18, 2004
INVENTOR(S) : Joel Mercier

It is certified that error appears in the above-identified patent and that said Letters Patent is hereby corrected as shown below:

Title page,
Item [75], Inventors, change "Joel Merciel" to -- Joel Mercier --

Signed and Sealed this

Sixteenth Day of November, 2004

JON W. DUDAS
*Director of the United States Patent and Trademark Office*